US007988258B2

(12) United States Patent
Saito

(10) Patent No.: US 7,988,258 B2
(45) Date of Patent: Aug. 2, 2011

(54) LINE-TYPE LIQUID EJECTING HEAD AND LIQUID EJECTING APPARATUS INCLUDING THE SAME

(75) Inventor: Shizuo Saito, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 732 days.

(21) Appl. No.: 12/016,131

(22) Filed: Jan. 17, 2008

(65) Prior Publication Data

US 2008/0174633 A1 Jul. 24, 2008

(30) Foreign Application Priority Data

Jan. 19, 2007 (JP) ..... 2007-010150

(51) Int. Cl.
*B41J 2/155* (2006.01)

(52) U.S. Cl. ..... 347/42

(58) Field of Classification Search ..... 347/42
See application file for complete search history.

(56) References Cited

U.S. PATENT DOCUMENTS

| | | | | |
|---|---|---|---|---|
| 6,042,222 | A * | 3/2000 | Moritz et al. | 347/65 |
| 6,183,063 | B1 | 2/2001 | Bolash et al. | |
| 6,652,079 | B2 * | 11/2003 | Tsuchii et al. | 347/65 |
| 7,413,294 | B2 * | 8/2008 | Tobita et al. | 347/84 |
| 7,431,434 | B2 * | 10/2008 | Agarwal et al. | 347/65 |

FOREIGN PATENT DOCUMENTS

| | | |
|---|---|---|
| JP | 01-238943 | 9/1989 |
| JP | 06-183029 | 7/1994 |
| JP | 06-344627 | 12/1994 |
| JP | 07-329294 | 12/1995 |
| JP | 08-174840 | 7/1996 |
| JP | 11-020176 | 1/1999 |
| JP | 2000-246901 | 9/2000 |
| JP | 2002-307686 | 10/2002 |
| JP | 2003-118109 | 4/2003 |
| JP | 2004-009744 | 1/2004 |
| JP | 2006-068941 | 3/2006 |
| JP | 2006-264268 | 10/2006 |

* cited by examiner

*Primary Examiner* — Jerry T Rahll
(74) *Attorney, Agent, or Firm* — Maschoff Gilmore & Israelsen

(57) ABSTRACT

A line-type liquid ejecting head includes an ejection unit group constituted by a plurality of ejection units each including a plurality of nozzle openings through which droplets of liquid are ejected, a pressure chamber communicating with the nozzle openings, and a pressure generator capable of generating a pressure change in the liquid in the pressure chamber, the liquid being supplied from a liquid source through a liquid supply channel to the pressure chambers and being ejected through the nozzle openings in a form of droplets by the pressure generators. The ejection unit group is sectioned into a plurality of unit blocks each constituted by a plurality of sets of the ejection units. Each of the unit blocks is provided with a block common channel, a distribution channel communicating with the liquid supply channel and the block common channel, and individual supply channels extending from the block common channel to the pressure chambers of the ejection units. The liquid supplied through the liquid supply channel is distributed through the distribution channels to the block common channels and is further supplied from the block common channels through the individual supply channels to the ejection units in the unit blocks. Droplets of the liquid are simultaneously ejected through the nozzle openings provided in the pressure chamber in each ejection unit upon driving of the corresponding pressure generator.

7 Claims, 4 Drawing Sheets

LINE-TYPE LIQUID EJECTING HEAD AND LIQUID EJECTING APPARATUS INCLUDING THE SAME

BACKGROUND

1. Technical Field

The present invention relates to line-type liquid ejecting heads, such as ink jet recording heads, and liquid ejecting apparatuses including the same. In particular, the invention relates to line-type liquid ejecting heads capable of stabilizing liquid supply to ejection units during droplet ejection operation, and liquid ejecting apparatuses including the same.

2. Related Art

Ink jet recording apparatuses, or printers, are categorized as liquid ejecting apparatuses. An ink jet recording apparatus includes, for example, an ink jet recording head (a liquid ejecting head called a serial head) that has a width smaller than the width of the recording medium, a head moving mechanism that reciprocates the recording head in a main scanning direction, and a transporting mechanism (recording medium feeding mechanism) that transports a recording medium, a target for liquid ejection such as recording paper, in a direction orthogonal to the main scanning direction for sub-scanning. The ink jet recording apparatus records images and the like on the recording medium by alternately repeating the main scanning of the recording head for ejecting ink droplets and the sub-scanning for transporting the recording medium. Such a method, however, has a problem in that, since the scanning speed of the recording head is limited, it takes a long time to record an image on the entirety of, for example, a relatively large recording medium.

Among apparatuses disclosed in recent years, an apparatus disclosed in FIGS. 2 to 4 of JP-A-6-183029 is configured to eject ink droplets from a long recording head immovably secured to an apparatus body. The recording head has nozzle openings aligned at a predetermined pitch with a width equivalent to the maximum recording width of the recording medium. Such a recording head is a line-type liquid ejecting head and is hereinafter referred to as a line head. This configuration does not require movement of the recording head in the main scanning direction and therefore enables recording of images and the like only by transportation of the recording medium in the sub-scanning direction. Accordingly, recording time is shorter than that of a configuration including the serial head.

A recording head of this type, such as the above-described line head, has groups of nozzles (rows of nozzles) provided for each type (color) of ink, and a common channel (reservoir) provided for each group of nozzles. Ink is supplied from an ink cartridge through a supply channel, such as an ink supply tube, to the common channel. The ink that has reached the common channel is distributed to the pressure chambers provided in correspondence with the nozzles. Driving of a pressure generator, such as a piezoelectric vibrator, generates a pressure change in the ink in the corresponding pressure chamber, whereby ink droplets are ejected through the nozzle openings.

Since this line head has more nozzle openings than the serial head, the common channel of the line head is naturally longer than that of the serial head in an arrangement direction of the rows of nozzles. This may cause a problem that the pressure chambers positioned farther from a connection between the common channel and the supply channel, through which ink is supplied from an ink source such as an ink cartridge to the common channel, have less ink supply. Particularly, in the case where ink droplets are to be ejected continuously at a higher frequency, ink supply may be delayed in the pressure chambers positioned farther from the connection.

SUMMARY

An advantage of some aspects of the invention is that it provides a line-type liquid ejecting head capable of stabilizing liquid supply to ejection units during droplet ejection operation, and a liquid ejecting apparatus including the same.

According to a first aspect of the invention, a line-type liquid ejecting head includes an ejection unit group constituted by a plurality of ejection units each including a plurality of nozzle openings through which droplets of liquid are ejected, a pressure chamber communicating with the nozzle openings, and a pressure generator capable of generating a pressure change in the liquid in the pressure chamber, the liquid being supplied from a liquid source through a liquid supply channel to the pressure chambers and being ejected through the nozzle openings in a form of droplets by the pressure generators. The ejection unit group is sectioned into a plurality of unit blocks each constituted by a plurality of sets of the ejection units. Each of the unit blocks is provided with a block common channel, a distribution channel communicating with the liquid supply channel and the block common channel, and individual supply channels extending from the block common channel to the pressure chambers of the ejection units. The liquid supplied through the liquid supply channel is distributed through the distribution channels to the block common channels and is further supplied from the block common channels through the individual supply channels to the ejection units in the unit blocks. Droplets of the liquid are simultaneously ejected through the nozzle openings provided in the pressure chamber in each ejection unit upon driving of the corresponding pressure generator.

In this configuration, the ejection unit group is sectioned into a plurality of unit blocks each constituted by a plurality of sets of the ejection units. Further, each of the unit blocks is provided with a block common channel, a distribution channel communicating with the liquid supply channel and the block common channel, and individual supply channels extending from the block common channel to the pressure chambers of the ejection units. Additionally, the liquid supplied through the liquid supply channel is distributed through the distribution channels to the block common channels and is further supplied from the block common channels through the individual supply channels to the ejection units in the unit blocks. Moreover, droplets of the liquid are simultaneously ejected through the nozzle openings provided in the pressure chamber in each ejection unit upon driving of the corresponding pressure generator. Therefore, liquid supply from the block common channels to the ejection units can be stabilized during liquid ejection operation. Consequently, liquid ejection characteristics of the ejection units can be made uniform.

Further, droplets are ejected through a plurality of nozzle openings in a single liquid ejection operation. Therefore, compared to a known configuration including a single nozzle opening for each pressure chamber, the droplets that have landed on the target for liquid ejection spread into a larger area to form a dot. Accordingly, a particular area on the target can be efficiently covered with dots with a smaller amount of liquid ejected. Thus, the total amount of liquid ejection required for covering the particular area becomes smaller than in the known configuration, and the amount of liquid supplied to the ejection units can be further stabilized.

In the line-type liquid ejecting head according to the first aspect, it is preferable that the nozzle openings provided in the pressure chamber be aligned in a direction in which the ejection units are aligned.

It is also preferable that the line-type liquid ejecting head include a plurality of the ejection unit groups, and that the adjacent ejection unit groups be arranged in parallel such that the ejection units are disposed in a staggered arrangement along a direction in which the ejection units are aligned.

This configuration provides partitions with a sufficient thickness between the adjacent ejection units and enables a high-density arrangement of the ejection units while preventing interference between the adjacent ejection units, i.e., so-called crosstalk.

In the line-type liquid ejecting head according to the first aspect, it is also preferable that the ejection units in the ejection unit group be arranged at different positions in a direction in which a target for liquid ejection is transported by providing the individual supply channels with different lengths, and that operation of ejecting droplets to the target be performed by time-division driving sequentially from the ejection units positioned at a most-upstream side, in the direction in which the target is transported, to the ejection units positioned at a most-downstream side.

In this configuration, operation of ejecting droplets to the target is performed by time-division driving sequentially from the ejection units positioned at a most-upstream side, in the direction in which the target is transported, to the ejection units positioned at a most-downstream side. Therefore, the number of the ejection units that communicate with each common channel and are driven simultaneously can be reduced. This suppresses rapid liquid consumption, thereby further stabilizing liquid supply to the ejection units.

In the line-type liquid ejecting head according to the first aspect, it is also preferable that each of the individual supply channels include an orifice channel that produces a channel resistance and an extended channel provided in accordance with a total length of the individual supply channel, that a cross section of the extended channel be set larger than that of the orifice channel, and that a length of the extended channel be set to become longer as the total length of the individual supply channel becomes longer.

In this configuration, the individual supply channel includes an orifice channel that has a constant length and produces a channel resistance and an extended channel provided in accordance with a total length of the individual supply channel. Further, a cross section of the extended channel is set larger than that of the orifice channel. Additionally, the length of the extended channel is set to become longer as the total length of the individual supply channel becomes longer. Therefore, even in a configuration including individual supply channels with different lengths, a constant channel resistance can be produced while the amount of liquid supplied to the ejection units is made uniform.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the drawings. Various descriptions provided as specific examples of preferred embodiments of the invention are not intended to limit the scope of the invention unless otherwise specified. The following embodiments will be described taking an image recording apparatus as an example of a liquid ejecting apparatus, specifically, an ink jet printer (hereinafter referred to as a printer) including a long line-type liquid ejecting head (hereinafter referred to as a line head) that has groups of nozzle openings aligned at a constant pitch, the groups having a total width equivalent to the maximum recording width of a recording paper sheet, which is the target for liquid ejection (a recording medium).

Figure 1:
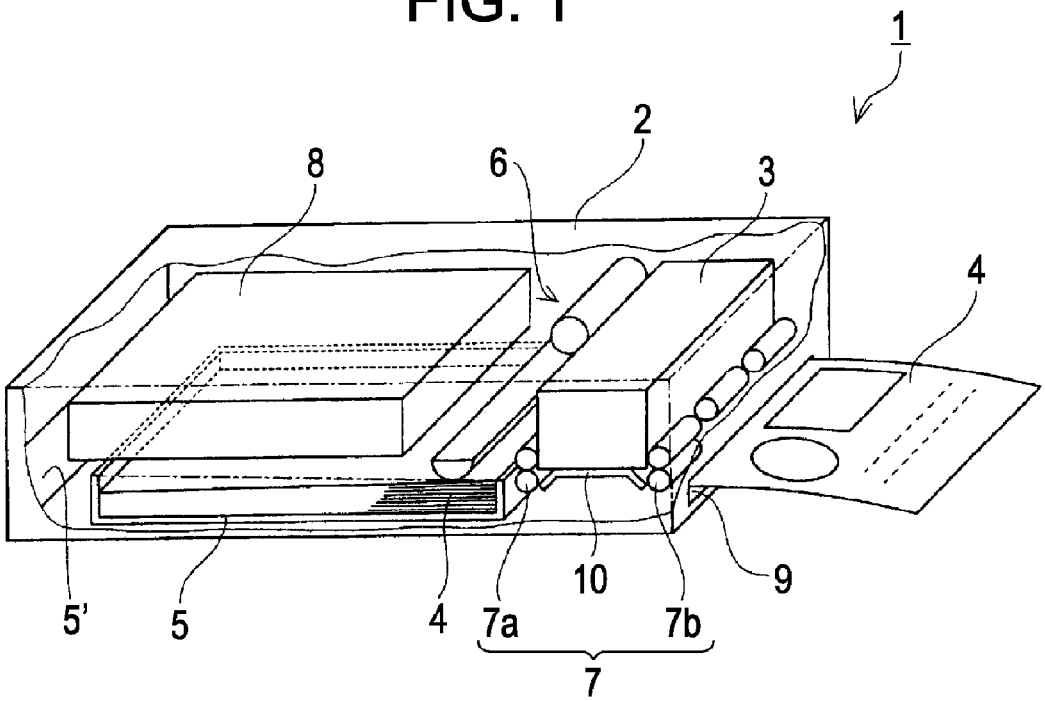
FIG. 1 is a partially opened perspective view showing the internal configuration of a printer.

FIG. 1 is a partially open perspective view that schematically shows a printer according to a first embodiment of the invention. A printer 1 of the first embodiment includes a casing 2. The casing 2 houses a line head 3, a paper tray 5 for storing recording paper sheets 4, a feed unit 6 that feeds the recording paper sheets 4 one by one from the paper tray 5 so that each of the recording paper sheets 4 is nipped between the line head 3 and a platen 10, a transporting unit 7 (a transporting mechanism) that transports the recording paper sheet 4 fed from the feed unit 6 onto the platen 10, and a controller 8 (a control unit) that controls operations of these components. The line head 3 is configured such that characters and images can be recorded with the full width of the recording area of the recording paper sheet 4 in an immovable state. The casing 2 also houses an ink cartridge (a liquid source, not shown) that stores ink. The ink stored in the ink cartridge is supplied (pumped) toward the line head 3 through ink supply tubes 27 (see FIG. 2) by applying a pressure to the inside of the ink cartridge with, for example, an air pump.

The casing 2 is a hollow, box-shaped member made of a material such as plastic. The casing 2 has a paper ejection slot 9 for ejecting the recording paper sheet 4, having images and characters printed thereon, in a lower portion of a side surface thereof at the downstream end of a direction in which the recording paper sheet 4 is transported, and a tray slot 5' in the opposite side surface thereof for insertion/removal of the paper tray 5.

The transporting unit 7 includes upstream feed rollers 7*a* that squeeze therebetween the recording paper sheet 4 fed from the feed unit 6 into a nip between the line head 3 and the platen 10, a paper guide (not shown) that provides a passageway through which the recording paper sheet 4 is to be fed, downstream feed rollers 7*b* that feed the recording paper sheet 4 passing through the nip between the line head 3 and the platen 10 toward the paper ejection slot 9, and a feed motor (not shown) that actuates the feed rollers 7*a* and 7*b*. The transporting unit 7 transports the recording paper sheet 4 placed at the feed unit 6 onto the platen 10, and ejects the recording paper sheet 4, which has images and the like recorded thereon by the line head 3, through the paper ejection slot 9.

Figure 2:
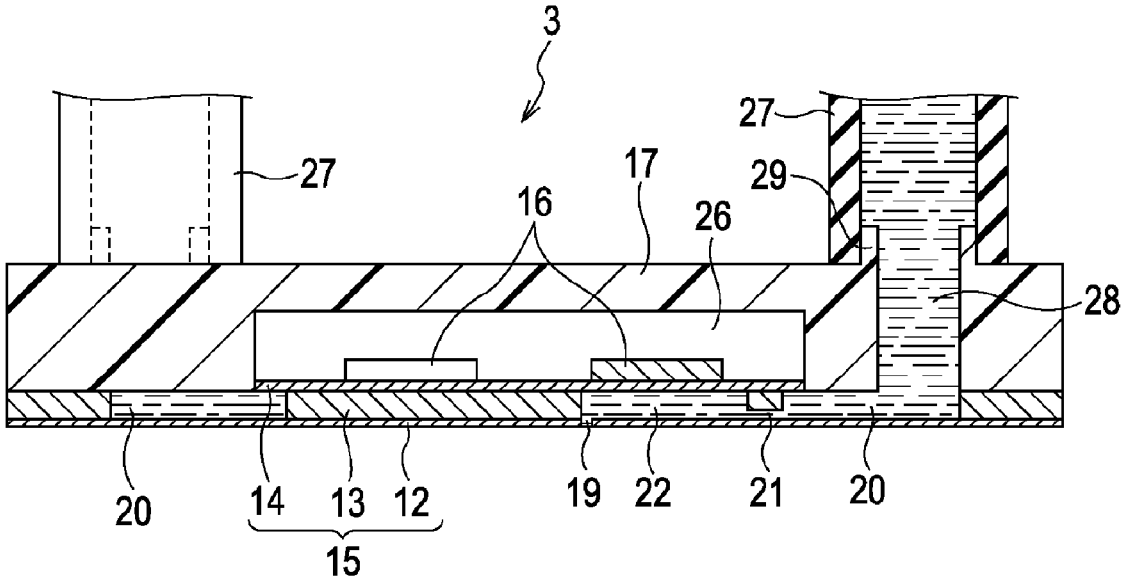
FIG. 2 is a cross-sectional view of a relevant portion of a line head.

FIG. 2 is a cross-sectional view of a relevant portion of the line head 3 according to the first embodiment. As a matter of convenience, a direction in which components of the line head 3 (head components) are stacked is referred to as the vertical direction. Although the first embodiment concerns the line head 3 that ejects a single kind (color) of ink (liquid in the invention), the invention may also be applied to a line head that ejects plural kinds (colors) of ink. The line head 3 includes a cavity unit 15 constituted by stacking a nozzle plate 12, a channel plate 13, and a vibrating plate 14; and piezoelectric elements 16 (pressure generators) disposed on the cavity unit 15. This stack is attached to a head case 17.

Figure 4:
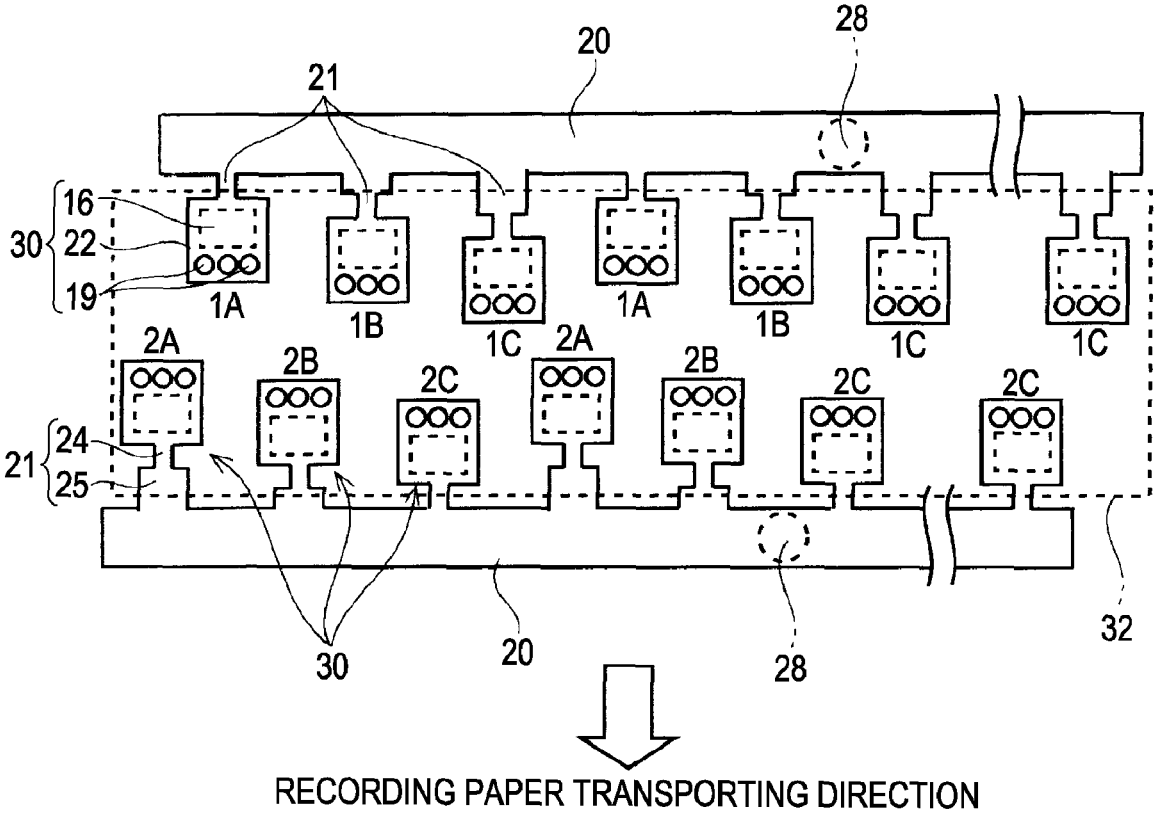
FIG. 4 is an enlarged view of a unit block and peripheral configurations thereof in the channel plate.

The nozzle plate 12 is a stainless steel plate having a plurality of nozzle openings 19 bored therethrough and aligned in a direction orthogonal to the direction in which the recording paper sheet 4 is transported (the recording paper width direction). In the first embodiment, referring to FIG. 4, three adjacent nozzle openings 19 constitute a single nozzle set. The nozzle openings 19 constituting each of the nozzle sets are aligned in the recording paper width direction (a direction in which ejection units are aligned). As shown in FIG. 4, the nozzle sets are staggered in the recording paper transporting direction. In the first embodiment, two groups (rows) of the nozzle sets are disposed next to each other in the recording paper transporting direction. Further, positions of the nozzle sets included in the same row are slightly different in the recording paper transporting direction. The arrangement of the nozzle sets will be described below in association with the ejection units. The number and arrangement direction of the nozzle openings 19 included in each of pressure chambers 22 are not limited to the one described herein. For example, four nozzle openings 19 may be arranged cruciformly.

Figure 3:
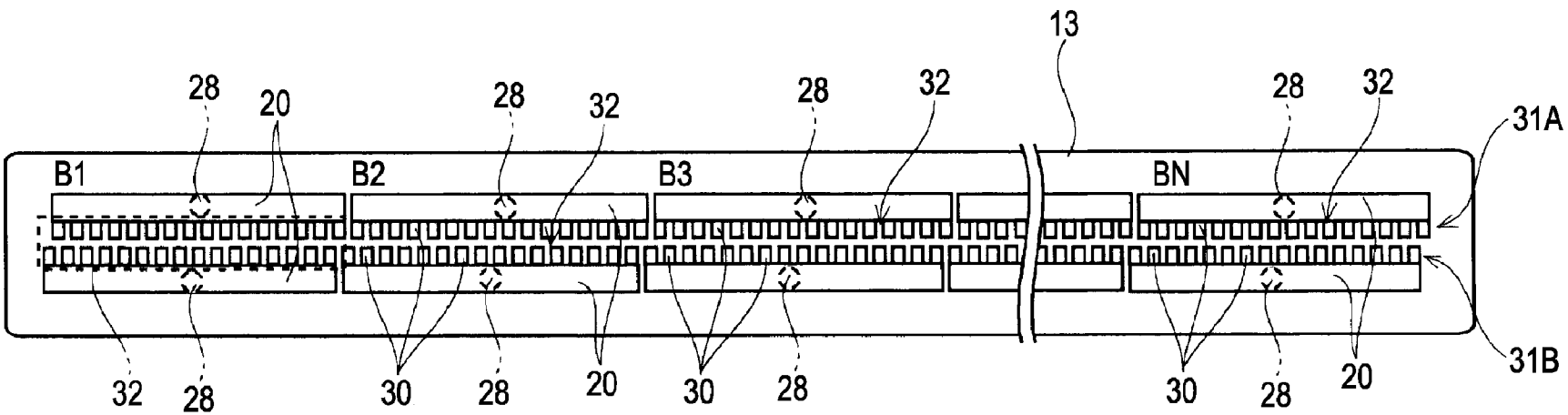
FIG. 3 is a plan view of a channel plate.

FIG. 3 is a general plan view of the channel plate 13. FIG. 4 is an enlarged plan view of a unit block and peripheral configuration thereof in the channel plate 13. The channel plate 13 of the first embodiment is made of, for example, a glass or ceramic plate. Portions serving as ink channels, i.e., openings serving as common channels (block common channels) 20; grooves serving as individual supply channels 21; and spaces (internal spaces of the pressure chambers) serving as the pressure chambers 22 are defined in the channel plate 13. The common channels 20 are spaces into which ink to be supplied to the pressure chambers 22 is introduced, and extend with a certain length in a direction in which the nozzle openings 19 are aligned. The common channels 20 are separate compartments provided in correspondence with unit blocks, which will be described below. The pressure chambers 22 are defined when the openings provided in the channel plate 13 as spaces for pressure chambers are sealed by the nozzle plate 12 and the vibrating plate 14. Referring to FIG. 2, each of the pressure chambers 22 communicates at one end thereof with the common channel 20 through the individual supply channel 21, and at the other end thereof with the nozzle openings 19 provided in the nozzle plate 12. Referring to FIG. 4, a nozzle set consisting of three nozzle openings 19 is provided for each pressure chamber 22.

The individual supply channel 21, which communicates with the common channel 20 and the pressure chamber 22 so as to supply ink stored in the common channel 20 to the pressure chamber 22, also functions as an orifice for producing a certain level of channel resistance. The individual supply channel 21 has a narrow cross section that limits the backflow of ink from the pressure chamber 22 to the common channel 20 at a predetermined level. The backflow of ink may occur upon an increase in the internal pressure of the pressure chamber 22 occurring at the ejection of ink droplets (liquid droplets). As shown in FIG. 4, the individual supply channels 21 of the first embodiment have different lengths in accordance with the positional relationships between the common channel 20 and the pressure chambers 22. The individual supply channels 21 that are the shortest each have a constant cross section, whereas the individual supply channels 21 that are longer than the former each form a channel having a two-tiered cross section including an orifice channel 24 having a narrow cross section and an extended channel 25 having a wider cross section than the orifice channel 24. The orifice channel 24 produces a certain level of channel resistance and has the same dimensions, including the cross section and the channel length, as the shortest individual supply channel 21. Dimensions of the extended channel 25 are determined in accordance with the overall length of the individual supply channel 21. The longer the individual supply channel 21, the longer the extended channel 25. The cross section of the extended channel 25 is set so as not to affect the resistance and inertance of the orifice channel 24. With such a configuration, the amount of ink supplied to ejection units 30 can be made uniform while a constant channel resistance is produced for the individual supply channels 21 with different lengths.

The vibrating plate 14, provided to seal the openings serving as the pressure chambers 22, is a flexible thin plate. The vibrating plate 14 supports on a top surface thereof (a surface remote from the nozzle plate 12) the piezoelectric elements 16. Each of the piezoelectric elements 16 is formed by sequentially stacking an electrode layer and a piezoelectric layer composed of, for example, lead zirconate titanate (PZT). The piezoelectric element 16 is provided for each of the pressure chambers 22. The piezoelectric element 16, which is a so-called flexural-mode piezoelectric element, is disposed on the vibrating plate 14 so as to overlap the pressure chamber 22. When a drive signal is supplied from a printer main body, the piezoelectric element 16 deforms in a contracting or stretching manner in accordance with the potential difference of the drive signal. With this deformation of the piezoelectric element 16, the vibrating plate 14 is deformed in a direction in which the volume of the pressure chamber 22 is reduced or increased.

The head case 17 is made of plastic such as thermoplastic resin, and the bottom surface thereof is bonded to the channel unit 15. The head case 17 has a housing space 26 for housing the piezoelectric elements 16, and case channels 28 (distribution channels) for supplying ink from the ink supply tubes 27 to the common channels 20. The case channels 28 are provided for the respective common channels 20 and penetrate through the head case 17 in the vertical direction. Each of the case channels 28 has at the upstream periphery thereof a connecting portion 29 projecting therefrom. The connecting portion 29 receives the ink supply tube 27 in a fluid-tight manner. The downstream end of the case channel 28 is opened to communicate with the common channel 20. Thus, the ink supply tube 27 and the common channel 20 communicate with each other through the case channel 28 in a fluid-tight manner.

In the line head 3, the nozzle openings 19 (the nozzle set), the pressure chamber 22, and the piezoelectric element 16 constitute the ejection unit 30. A plurality of the ejection units 30 aligned in the recording paper width direction constitute a line of an ejection unit group 31. As shown in FIGS. 3 and 4, the line head 3 of the first embodiment includes two ejection unit groups 31A and 31B disposed next to each other in the recording paper transporting direction such that the nozzle sets face each other and that the ejection units 30 are disposed in a staggered arrangement along the recording paper width direction (the direction in which the ejection units are aligned). In such a staggered arrangement, partitions defining the pressure chambers 22 can be made thicker than in the case where the pressure chambers 22 are aligned in a straight line. Consequently, the partitions defining the pressure chambers 22 have an increased rigidity with a sufficient thickness, whereby influence of pressure waves caused by ejection operation of adjacent pressure chambers 22 can be suppressed. Thus, the ejection units can be arranged at a high density while so-called crosstalk is prevented. Further, this contributes to time-division driving of the ejection units 30, which will be described below.

The ejection unit groups 31 are sectioned into a plurality of unit blocks 32 (B1 to BN). Each of the unit blocks 32 is constituted by a set of ejection units 30, and has the common channels (block common channels) 20 independent from each other. That is, the common channels 20 are intentionally provided separately for the same type (color) of ink. In the first embodiment, since each unit block 32 includes two rows of the ejection unit groups 31 disposed next to each other in the recording paper transporting direction, the unit block 32 includes two common channels 20. The line head 3 is configured such that ink supplied through the ink supply tubes 27 is distributed to the common channels 20 through the case channels 28 and reaches the ejection units 30 through the individual supply channels 21.

In the line head 3 configured as described above, the number of the ejection units 30 communicating with each common channel 20 can be made smaller than in a known line head having longer common channels. This stabilizes the amount of ink supplied to the pressure chambers 22 of the ejection units 30. Specifically, the difference in the amount of ink supplied (the volume of ink flow per unit time) can be reduced between the pressure chamber 22 of the ejection unit 30 nearest to the connection (the case channel 28) between the common channel 20 and the ink supply tube 27 and the pressure chamber 22 of the ejection unit 30 farthest from the connection between the common channel 20 and the ink supply tube 27. Consequently, ejection characteristics (e.g., the volume and flying speed of ink droplets ejected) can be made uniform for all the ejection units 30 when ink droplets are continuously ejected at a high frequency.

In the first embodiment that concerns a configuration in which each pressure chamber 22 includes a plurality of the nozzle openings 19, a single ejection operation of a single pressure chamber 22 causes simultaneous ejection of a plurality of ink droplets. Therefore, the ink droplets that have landed on the recording paper spread into a larger area to form a dot, compared to a known configuration including a single nozzle opening for each pressure chamber. Accordingly, a particular area on the recording paper can be efficiently covered with dots with a smaller amount of ink ejected. Thus, the total amount of ink ejection becomes smaller than in the known configuration, and the amount of ink supplied to the ejection units 30 can be stabilized.

Further, in the first embodiment, positions of the ejection units 30 in the ejection unit groups 31 are different in the recording paper transporting direction because lengths of the individual supply channels 21 are different. By driving the ejection units 30 in a time-division manner sequentially from the upstream side to the downstream side in the recording paper transporting direction during ink droplet ejection operation, the amount of ink supplied can be further stabilized.

This feature will be described with reference to FIG. 4. In FIG. 4, the ejection units 30 are denoted by reference numerals 1A to 1C for those belonging to a first row of the ejection unit group, and 2A to 2C for those belonging to a second row of the ejection unit group. In the example shown in FIG. 4, the ejection units 30 denoted by reference numeral 1A are disposed at the most-upstream positions in the recording paper transporting direction, and the ejection units 30 denoted by reference numeral 2C are disposed at the most-downstream positions. The ejection units 30 denoted as 1A to 1C and 2A to 2C are desirably positioned, in the recording paper transporting direction, at a pitch equivalent to a reference resolution (360 dpi, for example) to be referred to as the length of transportation of the recording paper sheet 4, or a pitch equivalent to an integral multiple of the reference resolution. The controller 8 drives the ejection units 30 sequentially in the order of 1A, 1B, 1C, 2A, 2B, and 2C while instructing transportation of the recording paper sheet 4 by the transportation length based on the reference resolution.

In such a configuration, although the recording speed becomes lower than in the case where the ejection units 30 are aligned in a straight line, the number of the ejection units 30 that communicate with each common channel 20 and are driven simultaneously can be reduced. This suppresses rapid ink consumption, thereby further stabilizing the amount of ink supplied. While FIG. 4 shows an example in which the individual supply channels 21 have three different lengths, the invention is not limited thereto.

The invention is not limited to the first embodiment, and various modifications can be made thereto within the scope of the appended claims.

For example, while the first embodiment concerns a configuration including the two rows of ejection unit groups 31A and 31B, the invention may also be configured to include one or three or more ejection unit groups.

Figure 5:
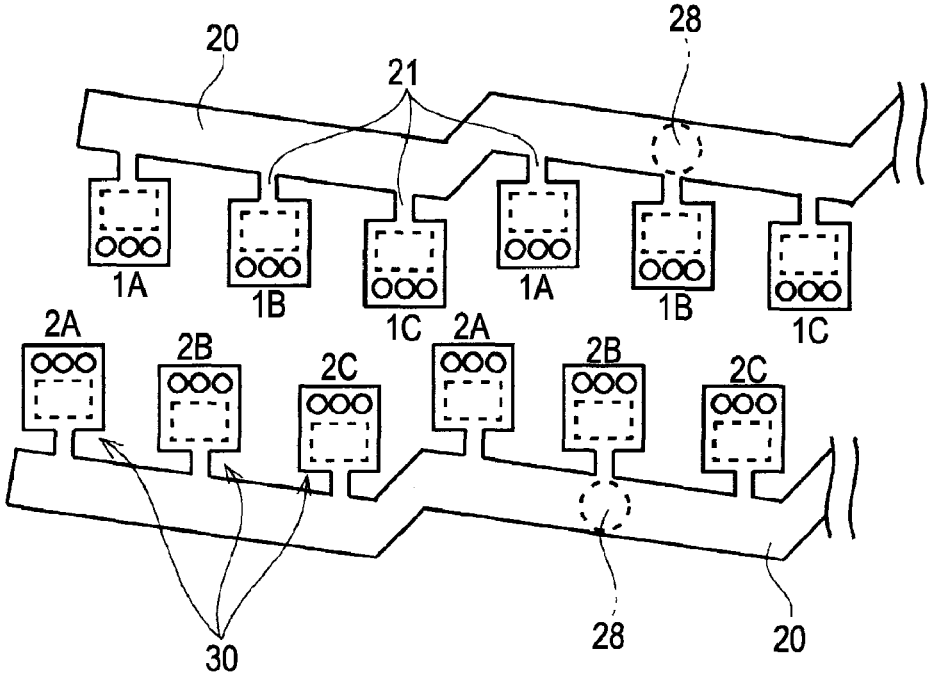
FIG. 5 is an enlarged view of a unit block according to a second embodiment and peripheral configurations thereof.

Further, while the first embodiment concerns a configuration in which the ejection units 30 included in each ejection unit group 31 are arranged at different positions in the recording paper transporting direction by providing the individual supply channels 21 with different lengths, another configuration such as a second embodiment shown in FIG. 5 may also be employed. The second embodiment is configured such that all the individual supply channels 21 have the same length but that the common channel 20 includes portions angled with respect to the recording paper width direction so as to arrange the ejection units 30 at different positions in the recording paper transporting direction. This configuration is advantageous in that it is easy to provide uniform ejection characteristics for all the individual supply channels 21 having the same length.

Figure 6:
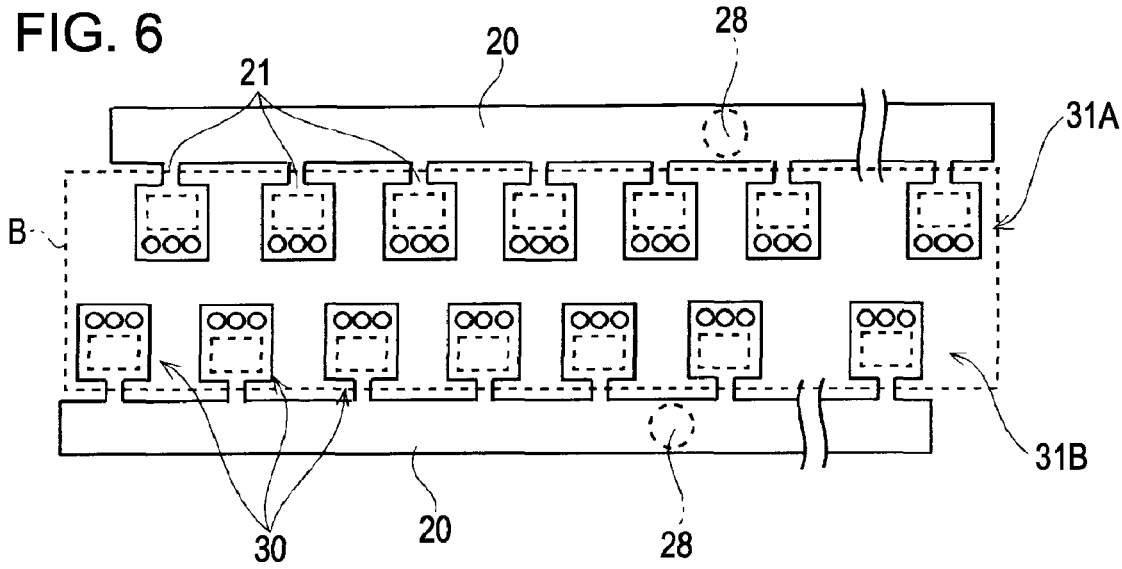
FIG. 6 is an enlarged view of a unit block according to a third embodiment and peripheral configurations thereof.

Further, while the first embodiment concerns a configuration in which the ejection units 30 communicating with each common channel 20 are arranged in different positions in the recording paper transporting direction, another configuration such as a third embodiment shown in FIG. 6 may also be employed. The third embodiment is configured such that the ejection units 30 communicating with each common channel 20 are arranged in a straight line in the recording paper width direction. In this configuration, the controller 8 drives the ejection unit group 31A on the upstream side, in the recording paper transporting direction, and the ejection unit group 31B on the downstream side in a time-division manner. The third embodiment improves the recording speed compared to the first embodiment.

Figure 7:
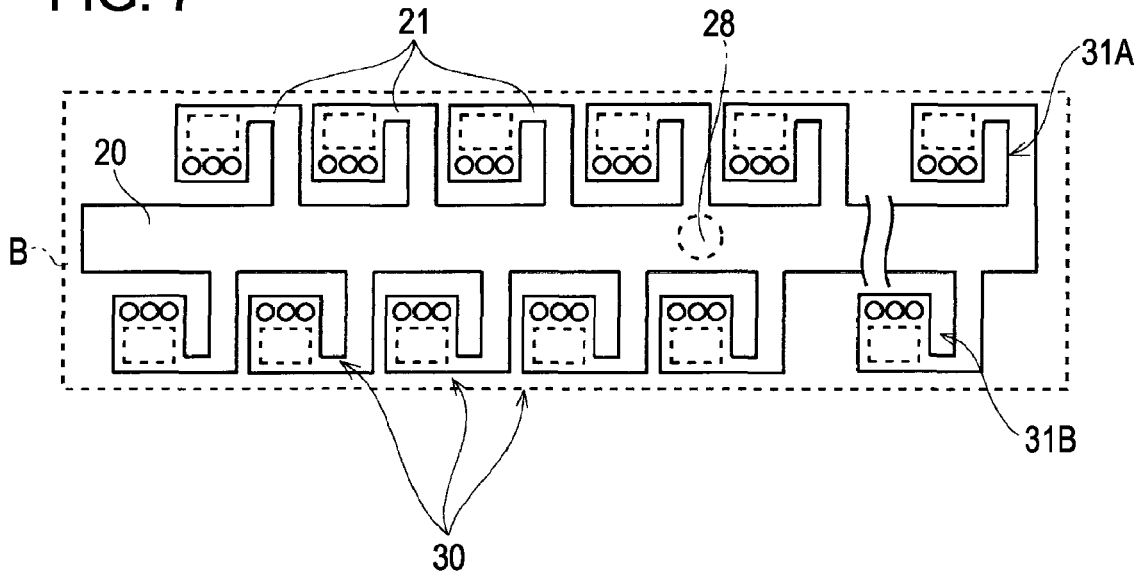
FIG. 7 is an enlarged view of a unit block according to a fourth embodiment and peripheral configurations thereof.

Further, while the first embodiment concerns a configuration including two common channels 20 for a single unit block 32, the invention may also be configured, as a fourth embodiment shown in FIG. 7, to include a single common channel 20 for a single unit block 32. In the fourth embodiment, a single common channel 20 is provided between the ejection unit group 31A and the ejection unit group 31B so that ink is supplied from the common channel 20 through the individual supply channels 21 to the ejection units 30 belonging to the same unit block 32. Each of the individual supply channels 21 extending from the common channel 20 reaches an end of the pressure chamber 22 on a side remote from the nozzle openings 19. In this configuration, the distance in the recording paper transporting direction between the ejection units 30 of the ejection unit group 31A and ejection units 30 of the ejection unit group 31B is larger than that in the first embodiment. However, the total number of the common channels 20 can be reduced, whereby the space required can be reduced.

Figure 8:
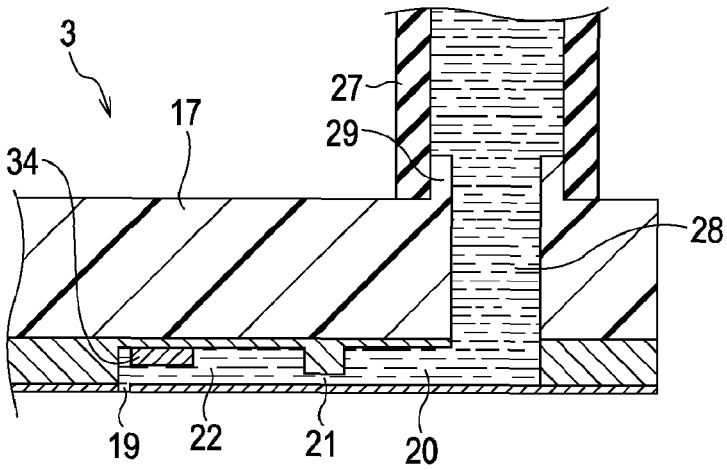
FIG. 8 is a cross-sectional view of a relevant portion of a line head according to a fifth embodiment.

Further, while the first embodiment concerns a configuration including the piezoelectric elements 16 of the so-called flexural vibration mode as pressure generators, the invention may also include pressure generators of other types, such as piezoelectric vibrators of the so-called vertical vibration mode, and heat generating elements 34, according to a fifth embodiment shown in FIG. 8, that generate heat to produce bubbles, thereby changing the pressure inside the pressure chambers 22.

Further, while the embodiments concern the line head 3, serving as a line-type liquid ejecting head, for recording images and the like by ejecting ink droplets, the invention may also be applied to line-type ejecting heads of other types, such as colorant ejecting heads used in manufacturing color filters included in liquid crystal displays, electrode material ejecting heads used in forming electrodes included in organic electroluminescent (EL) displays and field emission displays (FEDs, or surface-emitting displays), and bioorganic material ejecting heads used in manufacturing biochips (biochemical devices).

What is claimed is:

1. A line-type liquid ejecting head comprising:

an ejection unit group constituted by a plurality of ejection units each including a plurality of nozzle openings through which droplets of liquid are ejected, a pressure chamber communicating with the nozzle openings, and a pressure generator capable of generating a pressure change in the liquid in the pressure chamber, the liquid being supplied from a liquid source through a liquid supply channel to the pressure chambers and being ejected through the nozzle openings in a form of droplets by the pressure generators, the droplets being ejected towards a recording medium wherein the ejection unit group is sectioned into a plurality of unit blocks each constituted by a plurality of sets of the ejection units, wherein each of the unit blocks is provided with a block common channel, a distribution channel communicating with the liquid supply channel and the block common channel, and individual supply channels extending from the block common channel to the pressure chambers of the ejection units, the block common channel including off-set angled portions with respect to a width direction the recording medium such that the block common channel is non-linear, wherein the liquid supplied through the liquid supply channel is distributed through the distribution channels to the block common channels and is further supplied from the block common channels through the individual supply channels to the ejection units in the unit blocks, and wherein droplets of the liquid are simultaneously ejected through the nozzle openings provided in the pressure chamber in each ejection unit upon driving of the corresponding pressure generator.

2. The line-type liquid ejecting head according to claim 1, wherein the nozzle openings provided in the pressure chamber are aligned in a direction in which the ejection units are aligned.

3. The line-type liquid ejecting head according to claim 1, wherein the line-type liquid ejecting head includes a plurality of the ejection unit groups, and wherein the adjacent ejection unit groups are arranged in parallel such that the ejection units are disposed in a staggered arrangement along a direction in which the ejection units are aligned.

4. The line-type liquid ejecting head according to claim 1, wherein the ejection units in the ejection unit group are arranged at different positions in a direction in which a target for liquid ejection is transported by providing the individual supply channels with different lengths, and wherein operation of ejecting droplets to the target is performed by time-division driving sequentially from the ejection units positioned at a most-upstream side, in the direction in which the target is transported, to the ejection units positioned at a most-downstream side.

5. The line-type liquid ejecting head according to claim 1, wherein each of the individual supply channels includes an orifice channel that produces a channel resistance and an extended channel provided in accordance with a total length of the individual supply channel, wherein a cross section of the extended channel is set larger than that of the orifice channel, and wherein a length of the extended channel is set to become longer as the total length of the individual supply channel becomes longer.

6. The line-type liquid ejecting head according to claim 5, wherein the orifice channels have the same length for all the ejection units.

7. A liquid ejecting apparatus comprising:

the line-type liquid ejecting head according to claim 1; a transporting mechanism that transports a target for liquid ejection; and a controller that controls liquid ejection operation of the line-type liquid ejecting head, wherein droplets of the liquid are ejected through the nozzle openings of the line-type liquid ejecting head to the target in accordance with instructions from the controller while the transporting mechanism transports the target.

* * * * *